US006681715B2

(12) United States Patent
Wood

(10) Patent No.: US 6,681,715 B2
(45) Date of Patent: Jan. 27, 2004

(54) COLLAPSIBLE TRAFFIC BARRICADE AND SAFETY MARKER

(76) Inventor: Jeffrey Wood, W1165 Hwy. J, Wisconsin Dells, WI (US) 53965

( * ) Notice: Subject to any disclaimer, the term of this patent is extended or adjusted under 35 U.S.C. 154(b) by 0 days.

(21) Appl. No.: 10/010,457

(22) Filed: Dec. 7, 2001

(65) Prior Publication Data

US 2002/0078879 A1 Jun. 27, 2002

Related U.S. Application Data

(60) Provisional application No. 60/251,596, filed on Dec. 7, 2000.

(51) Int. Cl.[7] ..... E01F 13/02
(52) U.S. Cl. ..... 116/63 P; 116/63 R; 404/6
(58) Field of Search ..... 116/63 R, 63 T, 116/63 P

(56) References Cited

U.S. PATENT DOCUMENTS

| | | | | | |
|---|---|---|---|---|---|
| 2,762,327 | A | | 9/1956 | Weig | 116/63 |
| 2,819,547 | A | | 1/1958 | Clements, Jr. | 40/125 |
| 2,954,005 | A | | 9/1960 | Cioffi et al. | 116/63 |
| 3,132,624 | A | | 5/1964 | Schoemaker, Jr. | 116/63 |
| 3,490,749 | A | * | 1/1970 | Anderson | 116/63 P |
| 3,496,904 | A | | 2/1970 | Rimkus | 116/63 |
| 3,520,235 | A | | 7/1970 | Palazzolo et al. | 95/1.5 |
| 3,967,576 | A | | 7/1976 | Soerenson | 116/63 |
| 4,006,702 | A | | 2/1977 | St. Cyr | 116/63 |
| 4,183,695 | A | * | 1/1980 | Wilcox | 116/63 R |
| 4,197,807 | A | | 4/1980 | Campbell | 116/63 |
| 4,197,808 | A | | 4/1980 | Kinninger | 116/63 |
| 4,256,050 | A | | 3/1981 | Barnard | 116/63 |
| 4,312,600 | A | | 1/1982 | Schaaf et al. | 404/6 |
| 4,462,145 | A | | 7/1984 | Schulze | 29/428 |
| 4,466,376 | A | | 8/1984 | Wells | 116/63 |
| 4,541,190 | A | | 9/1985 | Weiner et al. | 40/610 |
| 4,668,120 | A | | 5/1987 | Roberts | 404/12 |
| 4,674,432 | A | * | 6/1987 | Schmanski | 116/63 R |
| 4,792,258 | A | * | 12/1988 | Goff | 116/63 P |
| 4,848,263 | A | | 7/1989 | Grimm | 116/63 |
| 4,925,334 | A | | 5/1990 | Beard | 404/9 |
| 5,036,791 | A | | 8/1991 | Thurston | 116/63 |
| 5,156,486 | A | | 10/1992 | Davidson | 404/10 |
| 5,287,822 | A | | 2/1994 | Anderson | 116/63 |
| 5,305,705 | A | | 4/1994 | Gagliano | 116/63 |
| 5,544,614 | A | * | 8/1996 | Cushman | 116/63 P |
| 5,621,992 | A | * | 4/1997 | Mandell et al. | 116/63 P |
| 5,729,215 | A | | 3/1998 | Jutras | 340/908.1 |
| 5,762,444 | A | * | 6/1998 | Giannelli | 116/63 P |
| 5,819,455 | A | | 10/1998 | Tsuda | 40/580 |
| 6,053,657 | A | | 4/2000 | Signorelli | 404/6 |
| 6,101,967 | A | * | 8/2000 | Glass et al. | 116/63 P |
| 6,109,820 | A | | 8/2000 | Hughes, Sr. | 404/10 |
| 6,382,870 | B1 | * | 5/2002 | Gertz | 116/63 P |

* cited by examiner

*Primary Examiner*—Diego Gutierrez
*Assistant Examiner*—Amanda J. Hoolahan
(74) *Attorney, Agent, or Firm*—Medlen & Carroll, LLP

(57) ABSTRACT

The present invention relates to a collapsible traffic barricade and safety marker device. In particular, the present invention provides an improved marker device formed by two pivotally attached members locked into operable position by one or more pivotally attached support beams at the base of the marker device.

15 Claims, 8 Drawing Sheets

FIG. 3A
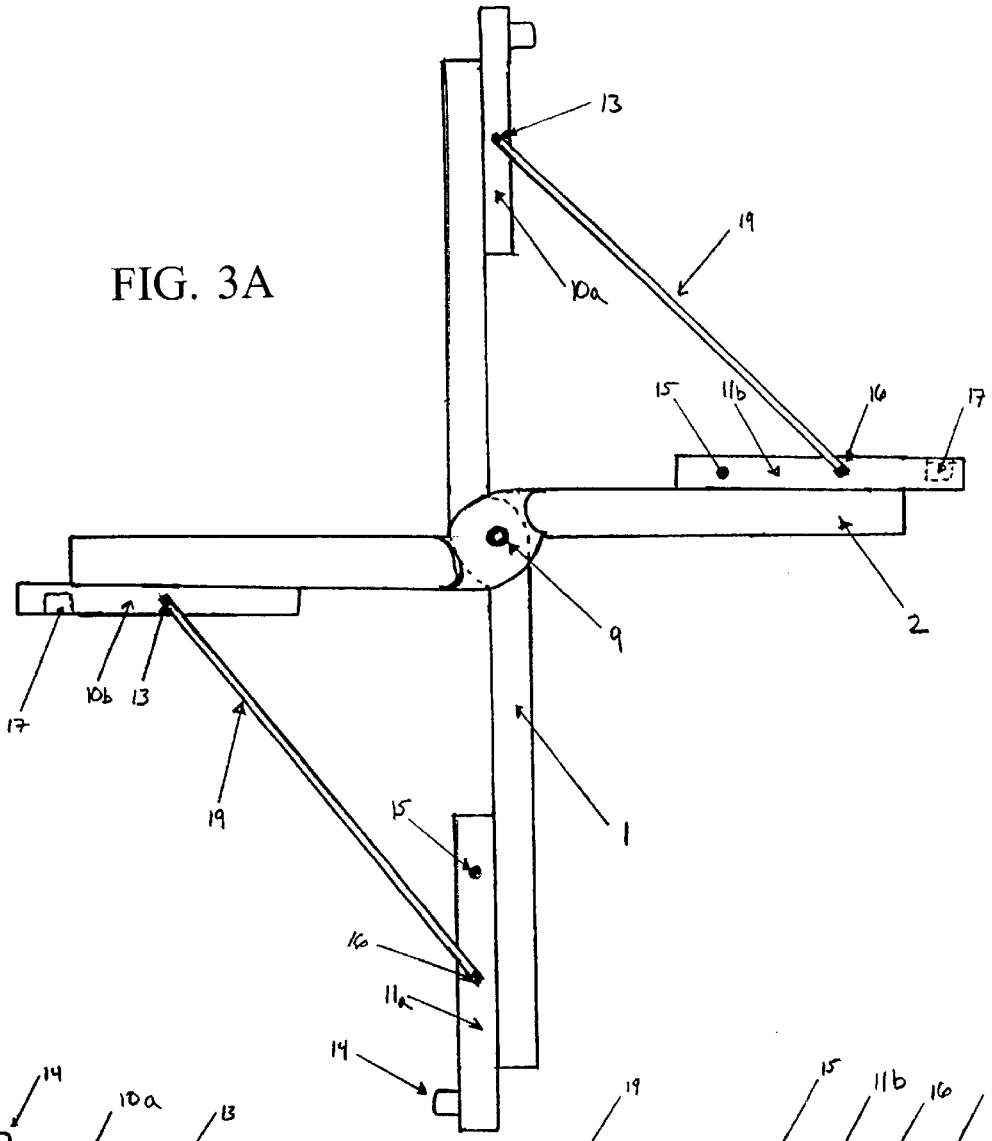
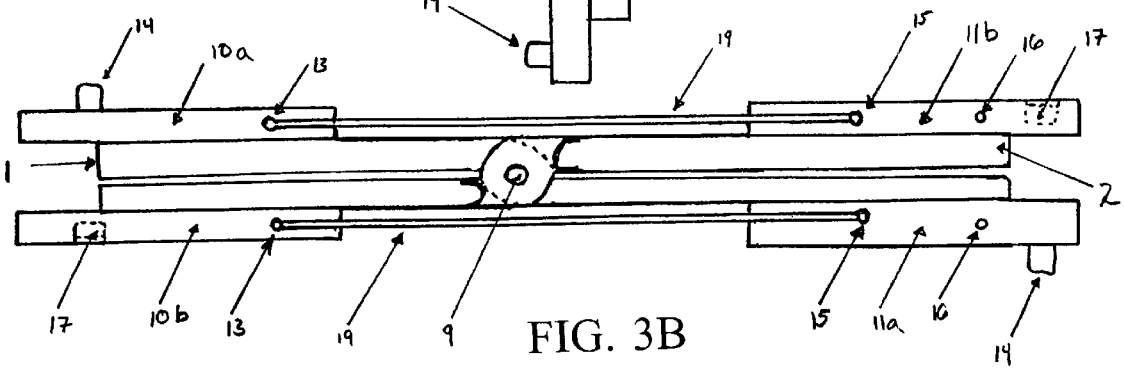
FIG. 3B

COLLAPSIBLE TRAFFIC BARRICADE AND SAFETY MARKER

The present Application claims priority to U.S. Provisional Application No. 60/251,596 filed, Dec. 7, 2000, hereby incorporated by reference in its entirety.

FIELD OF THE INVENTION

The present invention relates to a collapsible traffic barricade and safety marker device. In particular, the present invention provides an improved marker device formed by two pivotally attached members locked into operable position by one or more pivotally attached supports at the base of the marker device.

BACKGROUND OF THE INVENTION

Every year traffic fatalities combine to take the lives of the thousands of motorists, pedestrians, and highway workers. The human toll and economic loss from these tragic incidents is staggering.

Particularly alarming are the growing numbers of fatalities among highway construction and maintenance workers. According to the *National Work Zone Safety Clearinghouse,* 693 highway workers lost theirs lives while on the job in 1997. The number highway worker fatalities has increased every year to nearly 1,100 fatalities in the year 2000 alone. (See, http://wzsafety.tamu.edu).

A number of devices are known in the art which are designed to improve the safety of highway construction zones for both highway workers and motorists alike. Portable warning markers, particularly cone and barrel shaped markers, have long been known and used in the prior art as roadside construction zone markers. While cone and barrel shaped markers are universally recognizable by motorists and pedestrians, their bulky shapes often make these devices difficult to store, transport, and to set up. Conventional safety cones, even when stacked, can be difficult to transport and still require large amounts of storage space.

A number of collapsible marker devices have been developed to address the limitations of existing highway traffic safety devices. Each of these designs has it own advantages and disadvantages. One persistent problem in art is how to design sturdy safety devices which still are compact and easily stored.

What is needed, are traffic barricades and safety marker devices that are sturdy and adaptable but which require a minimum of storage space and are easily transported.

SUMMARY OF THE INVENTION

The present invention relates to a collapsible traffic barricade and safety marker device. In particular, the present invention provides an improved marker device formed by two pivotally attached members locked into operable position by one or more pivotally attached supports at the base of the marker device.

In a preferred embodiment the present invention provides a traffic barricade and safety marker device comprising: a first substantially planar upright member having a longitudinal axis and a first and second opposing faces, wherein said first substantially planar member has a first base part attached to said first face of said first substantially planar member, and a second base part attached to said second face of said first substantially planar member, a second substantially planar upright member having a longitudinal axis and a first and second opposing faces, wherein said second substantially planar member has a third base part attached to said first face of said second substantially planar member, and a fourth base part attached to said second face of said second substantially planar member, a first hinge part attached to said first substantially planar upright member, a second hinge part attached to said second substantially planar upright member, wherein said first hinge part is pivotally engaged by said second hinge part such that said first substantially planar upright member and said second substantially planar upright member are pivotally attached such that said first substantially planar upright member and said second substantially planar upright member can be pivoted to perpendicularly orientate said first substantially planar upright member and said second substantially planar upright member in relation to one another about said longitudinal axis of said first substantially planar upright member and said longitudinal axis of said second substantially planar upright member to form an substantially cruciform operable traffic barricade and safety marker device.

It is understood that the present invention, is not limited, however, to any particular arrangement or orientation of members or hinge parts. Indeed, in a another embodiment, the present invention provides a traffic barricade and safety marker device comprising: a first substantially planar upright member having a longitudinal axis and a first and second opposing faces, wherein said first substantially planar member has a first base part attached to said first face of said first substantially planar member, a second substantially planar upright member having a longitudinal axis and a first and second opposing faces, wherein said second substantially planar member has a second base part attached to said first face of said second substantially planar member, a third substantially planar upright member having a longitudinal axis and a first and second opposing faces, wherein third substantially planar member has a third base part attached to said first face of said third substantially planar member, a fourth substantially planar upright member having a longitudinal axis and a first and second opposing faces, wherein fourth substantially planar member has a fourth base part attached to said first face of said fourth substantially planar member, a first hinge part attached to said first substantially planar upright member, a second hinge part attached to said second substantially planar upright member, a third hinge part attached to said third substantially planar upright member, a fourth hinge part attached to said fourth substantially planar upright member, wherein each of said first, second, third, and fourth hinge parts are pivotally engaged to one another such that said first substantially planar upright member, said second substantially planar upright member, said third substantially planar upright member, and said fourth substantially planar upright members are pivotally attached such that said first substantially planar upright member, said second substantially planar upright member, said third substantially planar upright member, and said fourth substantially planar upright member can be pivoted to perpendicularly orientate said first substantially planar upright member, said second substantially planar upright member, said third substantially planar upright member, and said fourth substantially planar upright member, in relation to one another about said longitudinal axes to form an substantially cruciform operable traffic barricade and safety marker device.

In another preferred embodiment, the traffic barricade and safety marker device of further comprises a first semi-rigid support member pivotally attached to said first base part of said first substantially planar upright member, and a second semi-rigid support member pivotally attached to said first base part of said second substantially planar upright member. In other of these embodiments, the traffic barricade and safety marker said first semi-rigid support member is further pivotally attached to said second base part of said second substantially planar upright member, and said second semi-rigid support member is further pivotally attached to said second base part of said first substantially upright planar member.

In yet another embodiment, the traffic barricade and safety marker device, wherein a first hinge part is positioned at the longitudinal axis of said first substantially upright planar member. Additional embodiments, provide for a traffic barricade and safety marker device, wherein a second hinge part is positioned at the longitudinal axis of said second substantially upright planar member.

The present invention is not intended to be to limited to any particular arrangement (or number) of hinge parts.

Certain embodiments of the traffic barricade and safety marker device disclosed herein provide a first semi-rigid support and said second semi-rigid support to stabilize the traffic barricade and safety marker device when operatively positioned.

In particularly preferred embodiments, the traffic barricade and safety marker devices are nested for easier transport and storage. In some of these embodiments, the devices are nested in a nose-up to nose-down to nose-up, etc. orientation. In other embodiments, the devices are nested in a nose-up to nose-up, etc. orientation. The present invention is not intended to be limited any particular orientation of stacking (or nesting). In some embodiments, the one or more of base parts are designed to provide fastener devices that releaseably engage when one or more device are stacked (or nested).

In preferred embodiments, the members comprising the traffic barricade and safety marker devices are substantially hollow. Still other preferred embodiments provide members having one or more cavities proving a transversely defined opening in the from the first face to the second face of a member. The present invention is not intended to be limited by the orientation or number of openings in members faces. Furthermore, the members can additionally be provided with additional hooks, handles, hangers, and the like, to help lift and carry the devices.

In preferred embodiments, the traffic barricade and safety marker device disclosed herein are painted or molded in a color selected from the group consisting of highly visible shade of orange, red, yellow, and lime green. Other highly visible colors and contrasting paint schemes (e.g., one or more vertical or horizontal stripes) are also specifically contemplated (e.g., black and white, and red and white).

In still other embodiments, one or more of the members (or base parts) that comprise the traffic barricade and safety marker devices disclosed herein provide one or more adaptable safety devices. The present invention is not intended to be limited by the type or number of adaptable safety device attached (or molded) to the devices. Indeed, adaptable safety devices suitable for use with the present invention include, but are not limited to, one or more of the following, flares, flags, lights, audible warning devices, chains, panels, signs, and vehicle tire deflators.

Additional advantages and embodiments of the present invention will be apparent to those skilled in the art and intended to be within the scope of the present invention.

DESCRIPTION OF THE FIGURES

FIG. 3A provides a top plan view of one contemplated embodiment of the present invention when the marker device is erected for use. FIG. 3B provides top plan view of one contemplated embodiment of the present invention when marker device is collapsed for storage or transport.

DEFINITIONS

Figure 1A:
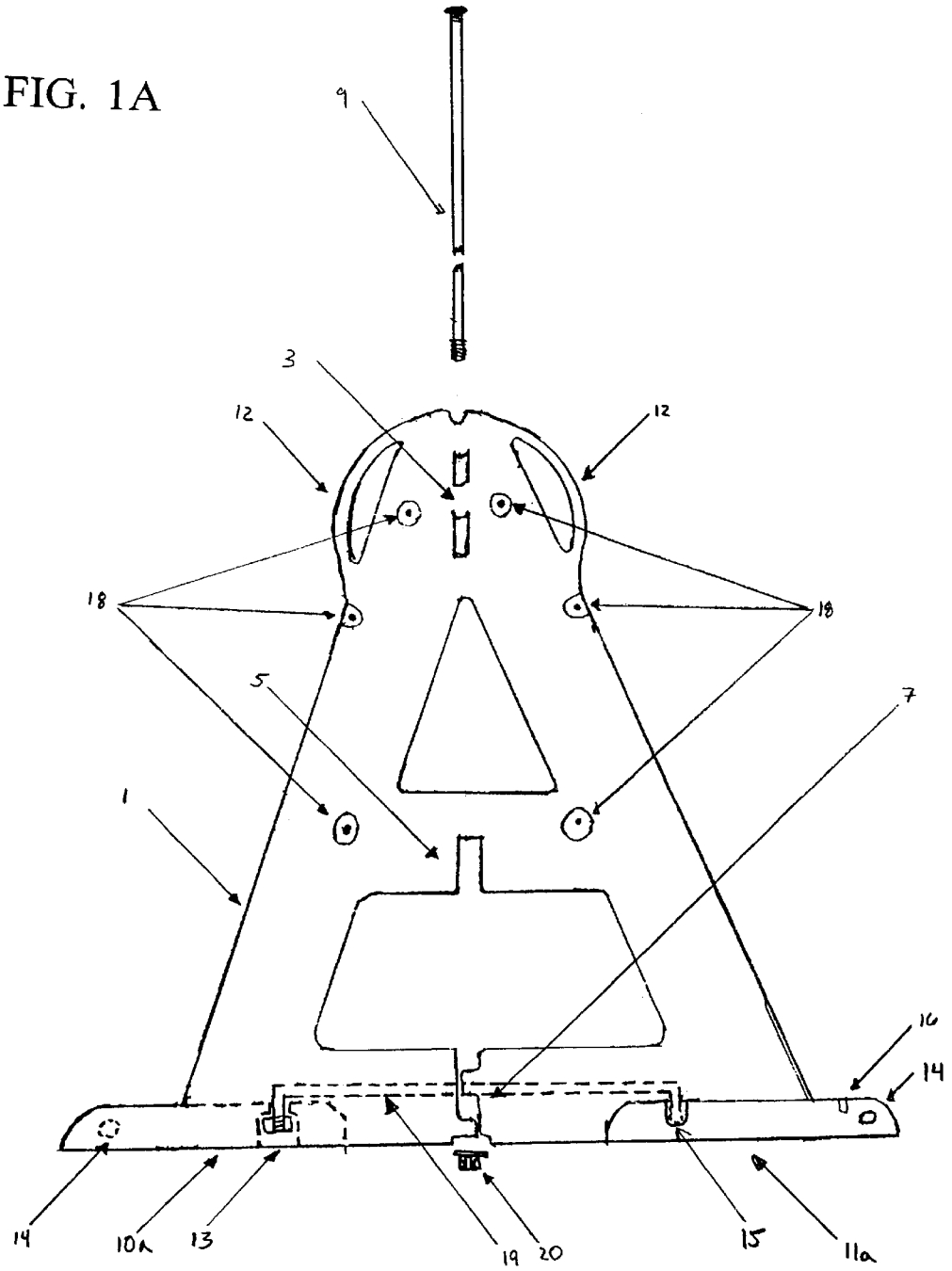
FIGS. 1A and 1B provide front elevation views of two contemplated member embodiments.

To facilitate an understanding of the present invention, a number of terms and phrases are defined below:

As used herein, the term "member" refers to any planar, or substantially planar, relatively thin (e.g., ⅛ inch to 6 inches) material (e.g., plastic, metal [e.g., aluminum], wood, rubber, and the like) orientated in the upstanding position and used in the erection of a marker device by engaging one or more additional upstanding members. In certain embodiments, substantially planar members comprise a slight (e.g., from about ¼ inch to about 3 inches or more) offset at their centers along their vertical axis when upstanding. It is understood that members, as used herein, owing to their substantially planar shape have two opposing faces. Preferred embodiments of the present invention are comprised of two or more, substantially planar upright members. In other preferred embodiments, members comprise one or more cavities transversely crossing from one face of the member to second face of the member.

The term, "hinge," or "hinge part" refers to any mechanical device, or a portion thereof, that allows two or more structures attached thereto to be pivotally connected.

As used herein, the term "base part" refers to an appendage (e.g., block, plate, channel, angle, tube, etc.) attached (e.g., bolted, screwed, glued, welded, integrally molded, etc.) to one or more faces of a member at its distal end when the member is orientated in the upstanding position and used in the erection of a marker device. In preferred embodiments, each member has one base part attached on each of its faces.

As used herein, the term "highly visible color" refers to any one or more a number of common traffic and safety device colors (e.g., fluorescent red, fluorescent yellow, fluorescent orange, fluorescent lime green). It is not intended, however, that the present invention be limited to fluorescent colors.

As used herein, the term "fastening device(s)" when used in reference to a base parts, refers any suitable device used for releasably attaching two or more objects together (e.g., a pin assembly, a snap assembly, screws, a nut and bolt assembly, and the like).

As used herein, the term "adaptable safety devices" refers to any number of devices used to prohibit or limit vehicular or pedestrian access to an area (e.g., chains, bars, panels, vehicle tire deflators, and the like), to visually warn vehicular or pedestrian traffic of dangerous situations (e.g., flares, flags, lights, and the like), audibly warning vehicular or pedestrian traffic of danger (e.g., sirens, and the like), or to convey symbolic (e.g., arrows, chevrons, "Xs," octagons, and the like) or textual information (e.g., signs).

DESCRIPTION OF THE INVENTION

The present invention relates to a collapsible traffic barricade and safety marker device. In particular, the present invention provides an improved marker device formed by two pivotally attached members locked into operable position by one or more pivotally attached supports at the base of the marker device.

While there have been a number of attempts to improve upon the portability and visibility of common cone shaped and "A frame" (sawhorse) traffic barricades and safety markers over the years, each of these efforts has certain disadvantages.

The efforts of the prior art can be generally be categorized into several broad categories. The first of group comprises a number of devices designed to provide telescoping cone sections that when extend and locked into to place provide a cone structure. An early version of a collapsible traffic cone is shown in U.S. Pat. No. 2,954,005. The device in this patent provides a number of sleeves of varying diameter and taper which when extended (i.e., telescoped) nest within one another to form a cone shaped marker. Similarly, U.S. Pat. No. 3,496,904 provides a plurality of upwardly-tapered, tubular, frutro-conical sleeves that when telescoped like those of the U.S. Pat. No. 2,954,005 patent also provide a cone shaped marker. U.S. Pat. No. 4,006,702 provides a collapsible cone shaped marker device comprising a continuous strip of a successively coiled semi-rigid material having a first and second lip such that when the coil is telescopically extended the first lip and second lips of the coil engage to hold the marker in an upright position. A conical marker device is described in U.S. Pat. No. 4,256,050 which is similar in design and operation to that of the U.S. Pat. No. 4,006,702 patent. U.S. Pat. No. 4,197,807 describes a further variation on the telescoping coiled spring maker devices. The marker device in U.S. Pat. No. 4,197,807 is self extended being held in a comprised position by a locking mechanism running through the center of the device, when the locking mechanism is disengaged i.e., loosed, the stored energy in coil is released and the device telescopes into position. In yet another variation on the telescoping coil design of marker devices, U.S. Pat. No. 4,256,050 patent describes a collapsible cone formed from a continuously extended plastic strip wound in a roll upon a base plate. A central handle permits lifting of the inner most turn of the roll which, in turn, lifts successive turns until the strip forms a vertically extending cone shaped helix. Spaced apart projections along the strip prevent the innermost turn from being pulled up so far from the base that successive turns of the helix separate from one another. U.S. Pat. No. 5,305,705 provides a cone shaped marker devices comprising a telescoping coil member and a self actuating locking mechanism. When the device of the U.S. Pat. No. 5,305,705 is erected, the telescoping coil member forms discontinuous open sided cone shape. Each of the above-mentioned marker devices is designed to be collapsed vertically, such that each of these devices collapses into a substantially planar base plate for storage and transport.

Collapsible cone shaped markers are not limited, however, to telescoping concentric coil designs. An inflatable cone shaped marker device is described in U.S. Pat. No. 2,762,327. The device of the U.S. Pat. No. 2,762,327 patent comprises a cone shaped flexible membrane with an internal air bladder fixed onto a planar base plate, a valve for inflating and deflating the device is also supplied. The marker device is stored in the base plate until being readied for use by attaching an external air supply and inflating the device to usable position. This device is dependent upon the integrity of its air valve and the internal air bladder. This device is susceptible to deflation due to leakage from the air value or puncture of the air bladder by means of flying gravel, glass or other projectiles caused by passing traffic is a constant threat to its integrity.

Various other U.S. patents describe variations on the flexible cone shaped marker design. For instance, U.S. Pat. No. 3,132,624 and U.S. Pat. No. 3,520,235 each describe a cone shaped marker device formed by extending and locking into place a central support member which holds a flexible conical sheet of plastic or other flexible sheet material which is supported in an erect position by means of a two piece center support member which disassembles for storage in a base. In the U.S. Pat. No. 3,132,624 patent, the support member comprises a spring having roughly the same dimensions as the interior of the flexible membrane when extended, while the U.S. Pat. No. 3,520,235 patent employs a two piece center support pole which disassembles for storage in a base. These marker devices are intended for personal use to warn traffic away from an automobile during an emergency road side repair, or the like. None of these device are well suited for use as a temporary markers for roadside construction and where thousands of markers need to be moved on a regular basis and where the markers are continuously subjected harsh environmental conditions (e.g., strong winds).

In still other designs, cone shaped marker devices are described in U.S. Pat. Nos. 4,462,145 and 4,466,376 that formed by folding a three panel fan shaped member, in the case of the U.S. Pat. No. 4,462,145 patent, and a four panel fan shaped member in the case of the U.S. Pat. No. 4,466,376 patent to form upright three sided triangles, and four sided triangles, respectively. The marker device described in the U.S. Pat. No. 4,462,145 patent is best suited to personal road safety applications in the event of vehicle breakdown. The marker device described in the U.S. Pat. No. 4,466,376 patent provides a planar base plate on which the erected cone shaped member is attached.

Figure 4:
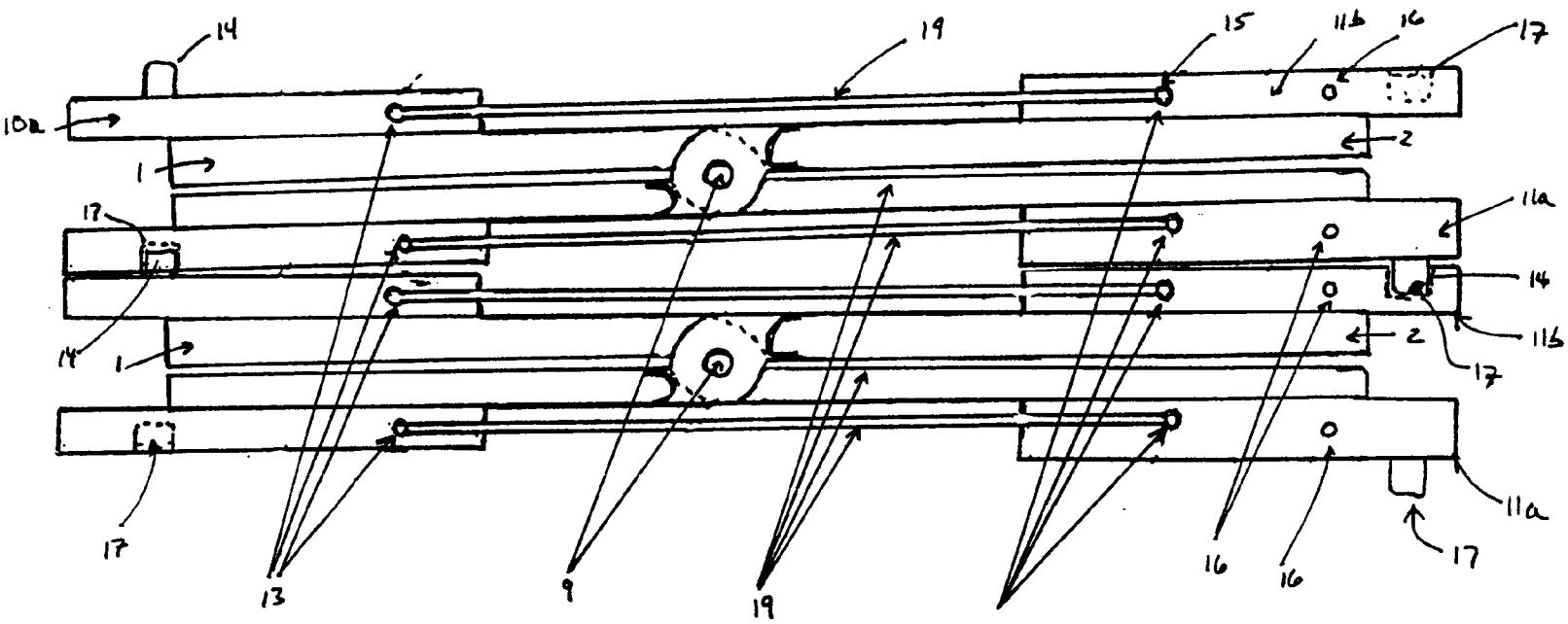
FIG. 4 provides top plan view of one contemplated embodiment of the present invention when two identical marker devices are collapsed and paired for transport of storage.

In yet another U.S. patent, a collapsible cone shaped marker device is described in U.S. Pat. No. 5,287,822. The reader's attention is referred to FIGS. 1–3 of U.S. Pat. No. 5,287,822. Briefly, the device described in the U.S. Pat. No. 5,287,822 patent consists of a semi-rigid isosceles triangle shaped member that is pivotally attached at its base to the center of a planar base plate. The isosceles triangle shaped member provides a small disk shaped platform at its central axis having shallow detentions such that the detentions are perpendicular to each face of isosceles triangle shaped member. The base plate further provides two additional detentions at the outer edge of the base plate perpendicular to those along the central axis of the semi-rigid isosceles triangle shaped member. Two small semi-rigid right triangular shaped members are pivotally attached one on each face of the semi-rigid isosceles triangle shaped member. Each of the semi-rigid right triangle shaped members provides a tab at its base adjacent to the right angle that engages aforementioned detention on the outer edge of the base plate when the respective right triangle shaped members are moved into position perpendicular to the face of the semi-rigid isosceles triangle member. Each of the detentions on the disk at the base of the semi-rigid isosceles triangle shaped member engages the base of one of the respective right triangle shaped members when that member is positioned perpendicular to the face of the semi-rigid isosceles triangle shaped member. The device is collapsed by disengaging the respective right triangle shaped members from each face of the isosceles shaped member and pivoting the assembly to a nearly horizontal orientation against the base plate. The asymmetrical folding and base plate in this design prohibits the nested storage of two or more devices. Suction cups are recommended to help secure the base plate of the marker assembly to the road surface. (See, U.S. Pat. No. 5,287,822, FIGS. 4–5).

In a preferred embodiment, the present invention provides a cone shaped marker device comprising two rigid (or semi-rigid) upstanding triangular shaped members pivotally attached to one another vertically through their respective centers. It is not intended that the present invention be limited to pivotally attaching two members at their centers. In certain embodiments where triangular member shapes other than substantially isosceles or equilateral are employed (e.g., acute or obtuse triangles), the members are sometimes pivotally attached at a point distant from their centers. In certain embodiments, the members are shaped as isosceles triangles. In certain other embodiments, the members are shaped as equilateral triangles. It is not intended that the present invention be limited to an particular triangular shape of the several members. A variety of triangular shaped members are contemplated encompassing a number of angles and side lengths. The present invention is not intended to be limited to a cone or triangular shape when erected. In certain embodiments, the present invention provides a barrel or rectangular shaped marker device. It will be appreciated that the same arrangement of foldable members illustrated in the present invention, may be used to form a simulated barrel type warning marker assembly. In such an embodiment, the pivotally attached members are rectangular (or substantially rectangular) in shape to simulate a barrel marker rather than a cone shaped marker. Otherwise, the construction and operation of such a simulated foldable barrel assembly will be the same as described herein in regard to cone shaped marker devices.

The present invention is not limited to any particular scale or size, of marker device. Indeed, various embodiments of the present invention contemplate a range of sizes and scales from those easily fitting in the trunk or glove box of an automobile, to conforming to standards for highway and traffic safety markers, and larger.

In preferred embodiments, the two members are pivotally attached at three hinge positions. However, the present invention is not intended to be limited by the configuration of the pivotal attachment of the respective members.

In some other embodiments, the present invention provides four rigid (or semi-rigid) triangular shaped members pivotally attached to one another vertically through their centers. In some of these embodiments, each of the four members comprises a right triangle pivotally attached to the other members at its side defined by the right angle. In other embodiments that employ four pivotally attached members, two of the members are of a first triangular shape (e.g., acute triangles) and the other two members are of a second triangular shape (e.g., obtuse triangle) that is different from that of the first two members. It is contemplated that embodiments of the present invention when configured in this design present a wedge shaped form when erected.

In some embodiments the members of the present device are semi-rigid. In other embodiments, the members of are rigid. A number of materials are contemplated for the construction of the members. Wood, metal, rubber, and plastics are all specifically contemplated as being suitable materials for member construction. In particular, wood members may be constructed out of various pressed and formed wood products (e.g., plywood, high density particle board, orientated strand board, heavy cardboard, and the like) as well as solid wood. Synthetic materials suitable for member construction include, but are not limited to, any impact resistant plastic or hardened rubber-like compound. Examples of suitable plastics include, but are not limited to, multipolymers, polycarbonates, polypropylenes (e.g., MIPS and HIPS), polystyrenes, polyurethanes, acrylonitrile styrene acrylate, acrylic-polycarbonate alloys (See e.g., Bayer Polymers Division, Pittsburgh, Pa.; Mitsubishi Plastics, White Plains, N.Y.; Atofina Chemicals, Inc., Philadelphia, Pa.; BASF, Corp., Mount Olive, N.J.). Suitable plastics are selected upon consideration of one or more of the following factors: impact resistance (e.g., deformation, splintering, shattering, etc.), chemical resistance (e.g., hydrocarbons and solvents), flammability, temperature resistance, resistance to molds, fungi, and other microorganisms, and fouling, UV stability and colorfastness, fabrication, durability (e.g., wear and hingeability), and cost. In certain embodiments, suitable recycled materials are employed for the fabricating the members, (e.g., plastics, and hard rubber).

In preferred embodiments, the members are painted or molded color in (e.g., when plastics are employed) in any one or more of a number of high visible or fluorescent colors (e.g., orange, yellow, red, lime green, etc.). Preferably, in those embodiments where members are fabricated from non-waterproof materials (e.g., wood products) a waterproof sealer or paint is provided.

In some embodiments that employ plastics as the construction material for the members, the members are fabricated (e.g., molded) to enclose an internal cavity. In some of these embodiments this cavity is filled with a impact resistance foam or other material that will improve the survivability of the marker device upon impact with a vehicle or other hard surface. In other of these embodiments, the cavity is filled with a flame retardant or suppressant material. In still other of these embodiments, the cavity is filed with a material that helps to stabilize and weigh down the marker device (e.g., sand and/or other aggregates, or water). It is not intended that the present invention be limited to using only one of the aforementioned cavity filling materials. Indeed, two or more suitable and compatible materials may be mixed or layered into a cavity.

In some embodiments, the marker devices are fabricated (e.g., molded) to include one or more handles integral to the members (See e.g., FIG. 1A), and/or one more handles can be attached to the members (e.g., screwed, bolted, welded, or glued, etc.). In some of these embodiments, the handles are designed to aid in the stackability and/or nesting of two or more collapsed marker devices. In some other embodiments, the marker devices further comprise a means (e.g., a hooks, rings, loops, straps, knobs, etc.) for grabbing and lifting the markers from the back of a passing vehicle. U.S. Pat. No. 5,287,822, incorporated herein in its entirety, describes various means that allow for garbing and lifting marker devices.

In preferred embodiments, the members are fabricated to provide one or more openings in the member's face. In particularly preferred embodiments, the members have one or more openings positioned near the center of their faces. In some of these embodiments, the opening comprises from 5–95%, from 20–80%, or from 35–65% of the surface area of the member. The present invention contemplates that openings in the faces of the members provide for improved stability in windy conditions by decreasing the surface area exposed to wind load. The above-mentioned openings in the members further provide additional options for grabbing, lifting, and carrying the marker devices and for easily binding two or more marker devices together for transport and storage.

Preferred embodiments of the present invention, when viewed from a top plan view, have a substantially cruciform shape. This cruciform shape provides the user with the distinct advantage of a marker device having four distinct viewing surfaces. The present invention contemplates that one or all of the four distinct viewing surfaces can be decorated with a variety of adaptable safety devices, including but not limited to, traffic control symbols (e.g., chevrons, arrows, octagons, etc.), reflective tape (e.g., SCOTCHLITE reflective material, 3M, Minneapolis, Minn.) or paint, text (e.g., "STOP," "YIELD," "CAUTION," etc.), lights (e.g., bulbs or LEDs), flags, flares, etc. The ability to rapidly re-orientate the marker device in relation to the incidence of view of oncoming traffic or pedestrians, coupled with the flexibility of having a single marker device capable of presenting four distinct traffic control and safety messages gives the user unsuppressed flexibility to convey a variety of information to vehicle operators and pedestrians as roadside and weather conditions change.

In still other embodiments, the vertical faces of the members provide one or more holes (e.g., for receiving through nuts and bolts), studs (e.g., threaded rods), recessed threaded opening, clips, hooks, screw eyes, and the like (e.g., attachment points). In certain of these embodiments, the aforementioned attachment points are used to support (e.g., attach) one or more additional safety or warning apparatuses (e.g., signs, flags, flares, chains, panels, lights, horns and sirens, and the like) to the marker device. In certain other of these embodiments, two or more marker devices are positioned such that the attachment points of several marker devices are spanned by chains, panels, and the like. Thus, in certain embodiments, three or more marker devices and corresponding attached panels or chains are configured to cordon off a site from vehicular or pedestrian access.

In some embodiments, the marker device is stabilized when erected solely by its cruciform shape. In some other embodiments, the marker device is further stabilized by providing base parts (e.g., weighted or un-weighted) to increase the surface area contacting the ground. In certain of these embodiments, the base parts are attached (e.g., bolted, screwed, molded, glued, etc.) to two or more, and preferably all four of the member faces. In preferred embodiments, the base parts comprise blocks of dense plastic, hardened rubber, or other similarly suitable material. In certain embodiments that comprising two pivotally attached members, one base part is attached on opposite ends on each face of a respective member. (See e.g., FIGS. 1A–3B). In those embodiments employing four pivotally attached members, the general orientation of the base parts remains the same, with the caveat that each member face provides only one base part. (See e.g., FIGS. 5 and 6).

In preferred embodiments, each of the base parts extends beyond the outside edge of the respective member from about 1–12 or more inches, preferably from about 6–8 inches, and more preferably from about 3–4 inches. Also in preferred embodiments, the base parts are positioned and attached to the respective members such that the gap between the ends of the base parts provides a space that substantially corresponds to the top of a second marker device. In particularly preferred embodiments, the orientation and configuration of the base parts allows the user to nest two or more marker devices together, such that the top of a first marker device nests within the space created by the base parts of a second marker device, and the top of the second marker device nests within the space created by the base parts of a third marker device, etcetera. In certain other embodiments where the members employ integral or attached handles, the handles are preferably designed also to nest within the space created by the base parts of an adjacent marker device when the devices are stacked.

In still other embodiments, the base parts further provide one or more protrusions (e.g., a pin, or a stud) on one or more of their vertical faces designed to fit within a corresponding cavity in the base part of another marker device in a male/female relationship. It is contemplated that the protrusions and corresponding cavities be positioned on the vertical faces of suitable base parts (i.e., perpendicular to the vertical plane of the erected marker device). (See e.g., FIGS. 2A and 2B). For example, in one embodiment, according to the stacking method described above, one or more protrusions on the base parts of a first marker device fit within corresponding cavities in the base parts of a third marker device (i.e., where the second marker device is nested between a first and a third marker devices) by way of further example, one or more protrusions on the base parts of a second marker device fit within corresponding cavities in the base protrusions of a fourth marker device (i.e., where the third marker device is nested between the second and fourth marker devices), etcetera. In this regard, it is not intended that the present invention be limited to any particular arrangement or number of protrusions and cavities. Indeed, any arrangement of corresponding protrusions and cavities that are suitably aligned for mating are within the scope of the present invention.

In certain other embodiments of the present invention, the marker device is stabilized by semi-rigid supports (e.g., threaded rod) pivotally attached to one or more, and preferably two, base parts such that the support of a first base part is free to engage a second base part (e.g., via a suitable cavity in the second base part). In certain of these embodiments the semi-rigid support encompass a bar, or rod, wherein both ends of the bar are bent such that right angles in the same plane and orientation are formed. In still further embodiments, a suitable first base part provides a cavity for receiving and pivotally attaching a portion of the first downwardly bent angle of the semi-rigid bar via a suitable means of attachment (e.g., a washer and nut assembly), while a suitable second base part provides a second cavity for receiving and attaching the second downwardly bent angle of the semi-rigid bar via an additional suitable means of attachment (e.g., a washer and nut assembly). It is not intended that the present invention be limited to any particular means of pivotally attaching the semi-rigid support to a first base part and a second base part. Indeed, sliding and telescoping mechanisms, and the like, are contemplated for providing support between a first member and a second member when the marker device is erected. In still other embodiments, the semi-rigid support is engaged to stabilize (e.g., to hold closed) the marker device during transport.

In still additional embodiments, the marker device is stabilized when erected by providing one or more well known weighting devices (e.g., sand bags) positioned against the several base parts. In yet other embodiments, the marker device is stabilized by providing a weighted ring over the several base parts (e.g., a suitably sized tire, or a section thereof, or a suitable fabricated enclosure).

It is to be appreciated that the various component parts of the marker devices disclosed herein are intended to be interchangeable with corresponding component parts of other similar markers. Thus, when a foldable marker device is damaged, its damaged component parts can be easily replaced, or the non damaged parts can be salvaged for use in other similar marker devices, thus avoiding the need to discard the entire assembly and purchase a new one to replace it as is ordinarily necessary when a prior art warning marker such as a cone or barrel is damaged.

DETAILED DESCRIPTION OF PREFERRED EMBODIMENTS

The present invention relates to a collapsible traffic barricade and safety marker device. In particular, the present invention provides an improved marker device formed by two (or more) pivotally attached members locked into operable position by one or more pivotally attached support beams at the base of the marker device. In additional preferred embodiments, a support (e.g., a threaded rod and nut assembly) is passed through the several pivotally attached members to provide a central axis and point of rotation for the erected device.

While the present invention can be embodied in many different forms and configurations, as provided for herein, several specific embodiments are provided in the attached Figures for exemplary purposes with the understanding that the present invention is not intended to be limited to the specific illustrated embodiments.

In preferred embodiments, the marker device is comprised of a first member being pivotally engaged to a second member (See, FIGS. 1A–4). FIGS. 2A and 2B, and 3A and 3B, respectively, illustrate the slight offset in each of members 1 and 2 in preferred embodiments. In other preferred embodiments, member 1 provides hinge parts 3, 5, and 7, respectively. In still other preferred embodiments, hinge parts 3, 5, and 7 each comprise a central cavity running longitudinally through the hinge part. In regard to FIG. 1B, in preferred embodiments, member 2 provides hinge parts 4, 6, and 8, respectively. In preferred embodiments, hinge parts 4, 6, and 8 each comprise a central cavity running longitudinally through the entirety of the hinge part.

In particularly preferred embodiments, hinge part 3 is provided by two cavities in member 1 that are designed for pivotally receiving two corresponding protrusions provided by hinge part 4 of member 2, in a male/female relationship. Also, in particularly preferred embodiments, hinge part 5 is provide by a cavity (e.g., a notch or groove) in member 1 that is designed for pivotally receiving a corresponding cavity (e.g., a notch or groove) provided by hinge part 5 of member 2. In still other particularly preferred embodiments, hinge part 7 is provided by two cavities in member 1 that are designed for pivotally receiving two corresponding protrusions provided by hinge part 8 of member 2, in a male/female relationship. It is not intended that the present invention be limited to the above-mentioned hinge part relationships. Indeed, any hinge mechanisms or devices suitable for the use in the disclosed marker device are within the scope of the present invention. For instance, the members may provide an eye and pin (e.g., a fence post hinge configuration) type mechanism at one or more of the hinge parts. An additional non-limiting example is provided, in certain embodiments where the marker device comprises four members pivotally engaged to one another to provide the erected marker device. In certain of these embodiments, the hinge parts are substantially similar to standard commercially available door hinge hardware configured so as to provide a four way pivotal joint when engaged and held to together by a suitable pin or other fastener.

Figure 1B:
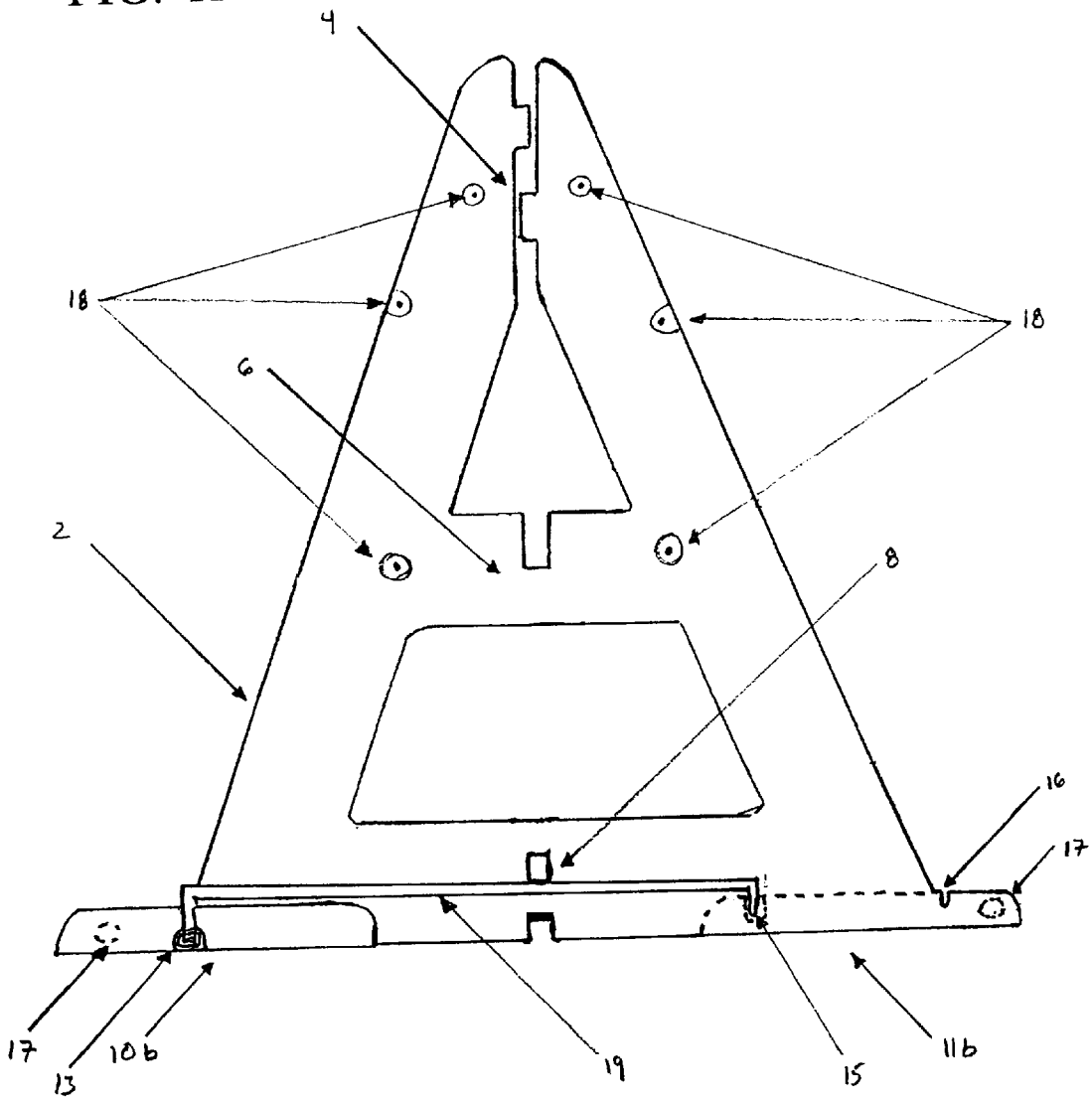
Figure 2A:
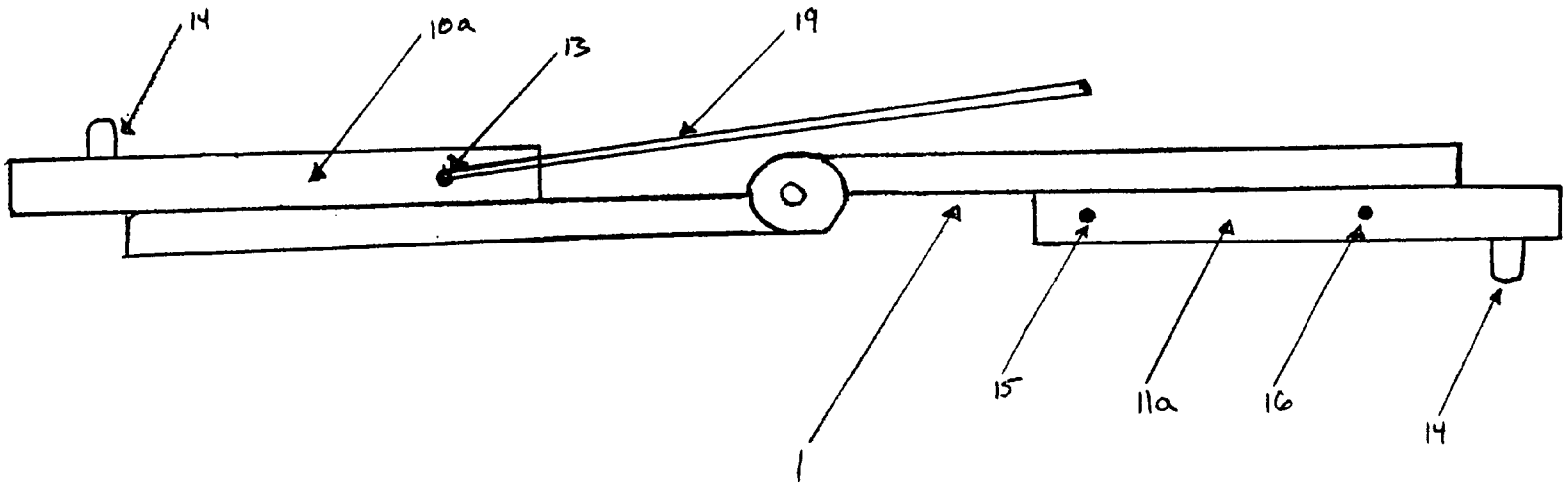
FIGS. 2A and 2B provide top plan views of two contemplated member embodiments.
Figure 2B:
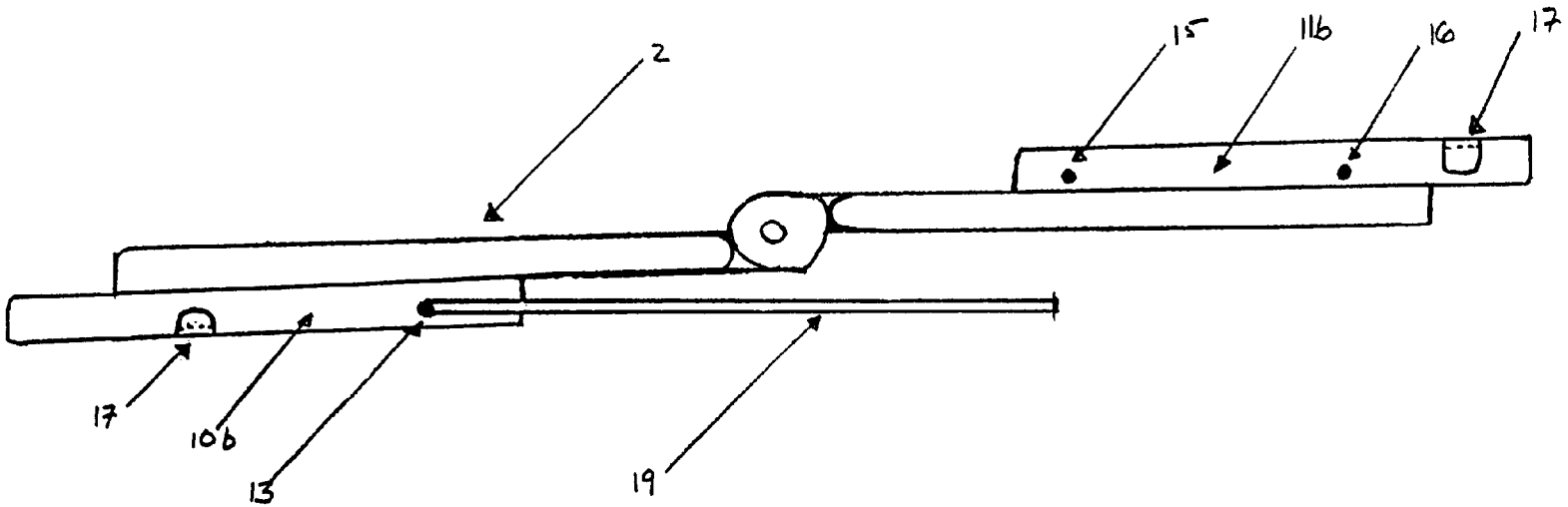

In particularly preferred embodiments of the present invention, the marker device is erected by pivotally attaching corresponding hinge parts 3, 5, and 7 of member 1 with hinge parts 4, 6, and 8 of member 2. Accordingly, in preferred embodiments, member 1 is pivotally attached to member 2 by associating hinge parts 3 and 4, hinge parts 5 and 6, and hinge parts 7 and 8, of members 1 and 2, respectively. In particular preferred embodiments, the respective hinge parts are brought together in the following manner. Hinge part 4 is opened (e.g., by applying pressure to the opposing split halves of the hinge part) such that hinge parts 7 and 5, of member 1 are passed sequentially over hinge part 4 as member 1 is being lowered over member 2. Likewise, hinge part 7 is then opened to allow it to pass hinge part 6. Hinge parts 5 and 6 of members 1 and 2, respectively, engage one another as the device is being assembled by the lowering of member 1 over member 2. Hinge parts 4 and 3, and 7 and 8 are engaged by opening hinge parts 4 and 7, respectively, and mating the corresponding hinge parts together. In particularly preferred embodiments, members 1 and 2 are made of a semi-rigid material (e.g., a suitable plastic material) that is sufficiently malleable to allow for slightly deforming the members to open their respective hinge parts (e.g., from about 2–3 inches, or more) to allow assembly of the marker device. When members 1 and 2 are pivotally connected in this manner, the longitudinal cavities in each of hinge parts 3, 4, 5, 6, 7, and 8 are brought into alignment, thus forming an integrally central axis throughout the pivotally attached members that is capable of accepting rod 9. In preferred embodiments, rod 9 comprises a threaded rod that is secured (e.g., by a nut and washer (20)) to members 1 and 2 at its proximal (i.e., top) end. In certain of these embodiments, member 1 provides a depression at it proximal end (as shown in FIG. 1A) to receive a means for securing rod 9 to pivotally attached members 1 and 2. Conversely, in other of these embodiments, member 2 provides a depression at it distal (i.e., bottom) end (as shown in FIG. 1B) to receive a means for securing rod 9 to pivotally attached members 1 and 2. In still further embodiments, rod 9 is designed to pin together members 1 and 2 and is self securing (e.g., screws into a threaded recess into member 1, or member 2, respectively). In yet other embodiments, rod 9 is left unsecured to the marker device and simply pins the structure together. In some embodiments, when rod 9 is installed it is flush with the top of the erected marker device. In other embodiments, rod 9 extends from about 2–12 or more inches, preferably from about 4–8 inches, and more preferably from about 2–4 inches above the erected marker device. In certain of these embodiments, rod 9 may further comprise a ring or hook at its end to help facilitate lifting and positioning the marker device.

Referring to FIG. 1A, in preferred embodiments, member 1 provides base parts 10*a* and 11*a*, one on each face of member 1. In certain preferred embodiments base parts 10*a* and 11*a* comprise hardened rubber or other suitable materials. In some embodiments, base parts 10*a* and 11*a* each extend beyond the member 1 from about 1–12 or more inches, preferably from about 6–8 inches, and more preferably from about 3–4 inches. In certain embodiments, base part 10*a* provides a cavity 13 suitable for pivotally attaching a semi-rigid support member (e.g., a threaded or unthreaded rod) 19 that is capable of engaging cavity 15, of base part 11*b* provided on member 2, when in the stored position, and engaging cavity 16, also of base part 11*b* on member 2, when the marker device is erected. (See e.g., FIGS. 3A and 3B). In preferred embodiments, semi-rigid support member 19 engages cavities 15 and 16 in a male/female coupling relationship. In other embodiments, semi-rigid support member 19 is threaded and engages cavities 15 and 16 being secured by a suitable attachment means (e.g., a washer and nut assembly). The present invention is not intended to be limited by the means used to secure the positioning of semi-rigid support member 19 to either cavity 15 or 16, as a number of suitable means are well known in the art.

Referring to FIG. 1B, some preferred embodiments of member 2 provide base parts 10*b* and 11*b*, one on each face of the member 2. In particularly preferred embodiments base parts 10*b* and 11*b* comprise hardened rubber or other suitable material. In some embodiments, base parts 10*b* and 11*b* each extend beyond member 2 from about 1–12 or more inches, preferably from about 6–8 inches, and more preferably from about 3–4 inches. In some embodiments, base part 10*b* provides a cavity 13 suitable for pivotally attaching a semi-rigid support member (e.g., a threaded or unthreaded rod) 19 that is capable of engaging cavity 15, of base part 11*a* provided on member 1, when in the stored position, and engaging cavity 16, also of base part Ha on member 1, when the marker device is erected. (See e.g., FIGS. 3A and 3B).

In other preferred embodiments, base part 10*a* provides one or more protrusions 14 (e.g., pins) are used to engage a corresponding cavity 17 on a base plate 10*b* in a male/female relationship when stacking several marker devices. (See e.g., FIG. 3C). In still other preferred embodiments, base part 11*a* similarly provides one or more protrusions 14 (e.g., pins) designed to engage a corresponding cavity 17 of base part 11*b*. (See e.g., FIG. 4). It is contemplated, in view of the preferred stacking order described above, that three or more marker devices should be stacked to realize the benefits of these protrusions and cavities. The present invention is not intended to be limited to any particular number or arrangement of protrusion of cavities for stacking purposes, the configurations provide in FIGS. 1A–4 are exemplary. Those skilled in the art will appreciate that certain embodiments of the present invention are contemplated where alternative means are devised to aid in stacking and transporting two or more marker devices.

In other embodiments, members 1 and 2, respectively, provide a plurality attachment points 18 for securing (e.g., screwing, bolting, hooking, etc.) one or more objects (e.g., flags, signs, lights, flares, sirens, motion detectors, panels, chains, etc.) to the members. In still further embodiments, one or both of members 1 and 2 provide integral (e.g., molded, or welded) handles 12 or other means for carrying and lifting the marker devices. (See, e.g., FIG. 1A).

Figure 5:
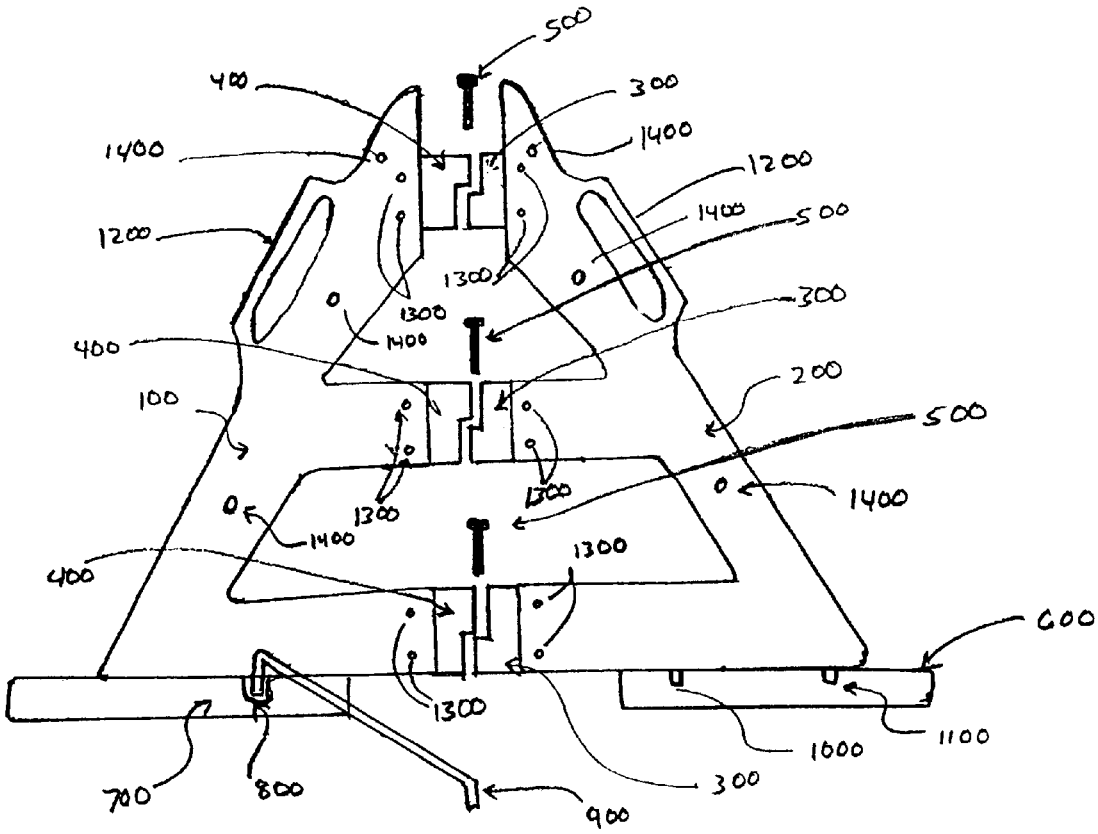
FIG. 5 provides a front elevation view of two contemplated members of the present invention.
Figure 6:
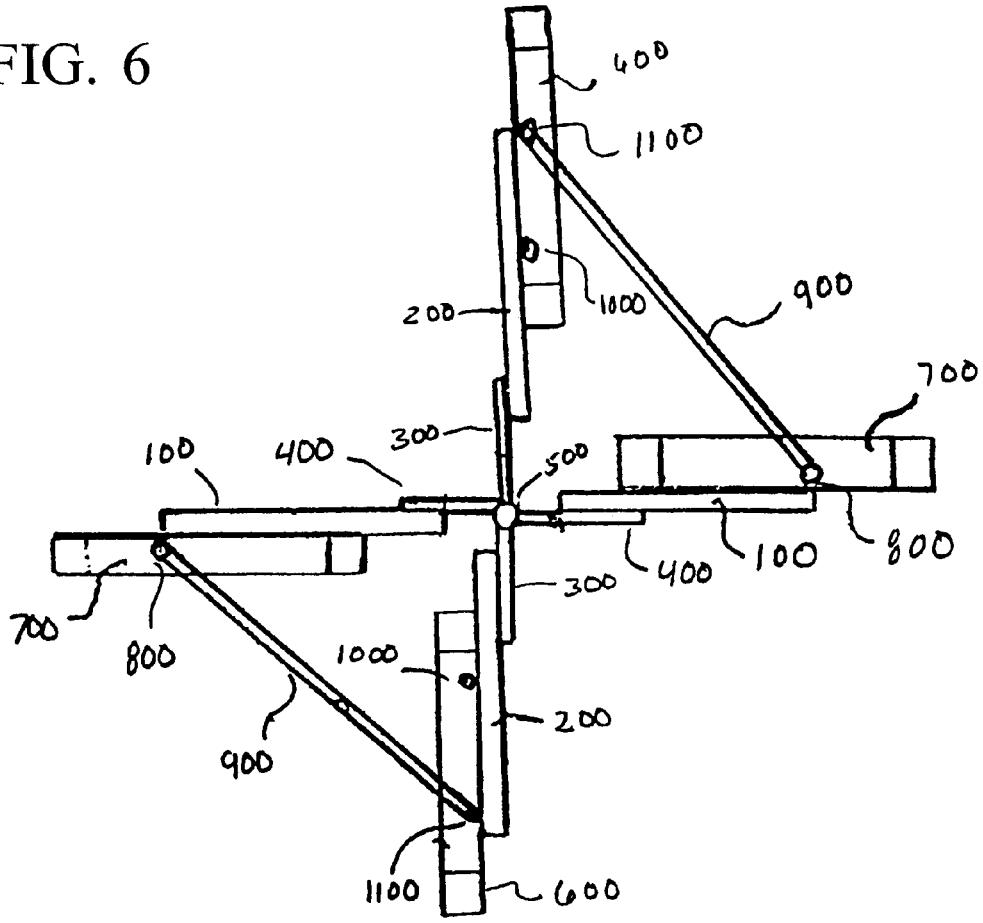
FIG. 6 provides top plan view of one contemplated embodiment of the present invention when the marker device is erected for use.

In still another embodiment, illustrated in FIGS. 5 and 6, the marker device comprises four pivotally attached members. In reference to FIGS. 5 and 6, member 100 provides three hinge parts 400 that pivotally engage to three corresponding hinge parts 300 of member 200. In preferred embodiments each of hinge parts 400 are separately attached to each of two members 100, as illustrated in the over head view of the erected marker device in FIG. 6. Likewise, in preferred embodiments, each of hinge parts 300 are separately attached to each of two member 200, also as illustrated in the over head view of the erected marker device in FIG. 6. In preferred embodiments, hinge parts 400 of each member 100 are, respectively, attached to the members via suitable fastening means (e.g., adhesives, welds, screws, or nuts and bolts, rivets, etc.) at 1300. In other preferred embodiments, hinges parts 300 of each of member 200 are, respectively, attached to the members via suitable fastening means (e.g., adhesives, welds, screws, or nuts and bolts, rivets, etc.) at 1300. In certain preferred embodiments, the marker device comprising two members 100 and two members 200, respectively attached to each of three hinge parts 300 (in case of members 200), and hinge parts 400 (in the case of members 100) that are pivotally attached by engaging each of hinge parts 300 with each of hinge parts 400 and securing the respective pivotally engagements by suitable fastening means (e.g., a pin, or a nut and bolt, etc.) by fastener 500 as illustrated in FIGS. 5 and 6.

In still other preferred embodiments, the marker device illustrated in FIGS. 5 and 6, further comprise several base parts. In reference to FIGS. 5 and 6, each member 100 provides a base part 700, and each member 200 provides a base part 600, respectively. In certain preferred embodiments base parts 700 and 600 comprise hardened rubber or other suitable material. In some embodiments, base parts 700 each extend beyond the member 100 from about 1–12 or more inches, preferably from about 6–8 inches, and more preferably from about 3–4 inches. In certain embodiments, base part 700 provides a cavity 800 suitable for pivotally attaching a semi-rigid support member (e.g., a threaded or unthreaded rod, and the like) 900 that is capable of engaging cavity 1000, of base part 600 provided on members 200, when in the stored position, and engaging cavity 1100, also of base part 600 on member 200, when the marker device is erected. (See e.g., FIGS. 5 and 6). In preferred embodiments, semi-rigid support member 900 engages cavities 1000 and 1100 in a male/female coupling relationship. In other embodiments, semi-rigid support member 900 is threaded and engages cavities 1000 and 1100 being secured by a suitable attachment means (e.g., a washer and nut assembly). The present invention is not intended to be limited by the means used to secure the positioning of semi-rigid support member 900 to either cavity 1000 or 1100 a number of suitable means are well known in the art.

In other embodiments, each of members 100 and 200, respectively, provide a plurality attachment points 1400 for securing (e.g., screwing, bolting, hooking, etc.) one or more objects (e.g., flags, signs, lights, flares, sirens, motion detectors, panels, chains, etc.) to the members. In still further embodiments, one or more of members 100 and 200 provide integral (e.g., molded, or welded) handles 1200 or other means for carrying and lifting the marker devices. (See, e.g., FIG. 5).

All publications and patents mentioned in the above specification are herein incorporated by reference. Various modifications and variations of the described device and apparatuses of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described embodiments of the invention which are obvious to those skilled in material sciences, construction and fabrication sciences, engineering, and safety specialists, or related fields are intended to be within the scope of the following claims.

We claim:

1. A traffic barricade and safety marker device comprising:

a first substantially planar upright member having a longitudinal axis at its center and first and second opposing faces, wherein said first substantially planar member has a first base part attached to said first face of said first substantially planar member, and a second base part attached to said second face of said first substantially planar member, a second substantially planar upright member having a longitudinal axis at its center and first and second opposing faces, wherein said second substantially planar member has a third base part attached to said first face of said second substantially planar member, and a fourth base part attached to said second face of said second substantially planar member, a first hinge part attached to said first substantially planar upright member, a second hinge part attached to said second substantially planar upright member, wherein said first hinge part is pivotally engaged by said second hinge part such that said first substantially planar upright member and said second substantially planar upright member are pivotally attached such that said first substantially planar upright member and said second substantially planar upright member can be pivoted to perpendicularly orientate said first substantially planar upright member and said second substantially planar upright member in relation to one another about said longitudinal axis of said first substantially planar upright member and said longitudinal axis of said second substantially planar upright member to form an substantially cruciform operable traffic barricade and safety marker device.

2. The traffic barricade and safety marker device of claim 1, further comprising a first semi-rigid support member pivotally attached to said first base part of said first substantially planar upright member, and a second semi-rigid support member pivotally attached to said first base part of said second substantially planar upright member.

3. The traffic barricade and safety marker device of claim 2, wherein said first semi-rigid support member is further pivotally attached to said second base part of said second substantially planar upright member, and said second semi-rigid support member is further pivotally attached to said second base part of said first substantially upright planar member.

4. The traffic barricade and safety marker device of claim 1, wherein said first hinge part is positioned at the longitudinal axis of said first substantially upright planar member.

5. The traffic barricade and safety marker device of claim 1, wherein said second hinge part is positioned at the longitudinal axis of said second substantially upright planar member.

6. The traffic barricade and safety marker device of claim 1, wherein said first semi-rigid support and said second semi-rigid support stabilize said traffic barricade and safety marker device when operatively positioned.

7. The traffic barricade and safety marker device of claim 1, nested with a second or more identical traffic barricade and safety marker device.

8. The traffic barricade and safety marker device of claim 1, wherein two or more of said traffic barricade and safety marker devices are stacked, such that a fastener on said first base parts engages a corresponding fastener on said third base part, and such that a fastener on said second base part engages a corresponding fastener on said fourth base part.

9. The traffic barricade and safety marker device of claim 1, wherein said first substantially upright planar member is substantially hollow.

10. The traffic barricade and safety marker device of claim 1, wherein said second substantially upright planar member is substantially hollow.

11. The traffic barricade and safety marker device of claim 1, wherein said first substantially upright planar member has a cavity such that when the said first substantially upright planar member is orientated in operable position, said cavity provides an opening from said first face to said second face of said first substantially upright planar member.

12. The traffic barricade and safety marker device of claim 1, wherein said second substantially upright planar member has a cavity such that when the said second substantially upright planar member is orientated in operable position, said cavity provides an opening from said first face to said second face of said second substantially upright planar member.

13. The traffic barricade and safety marker device of claim 1, wherein said first substantially upright planar member is colored with a color selected from the group consisting of highly visible shade of orange, red, yellow, and lime green.

14. The traffic barricade and safety marker device of claim 1, wherein adaptable safety devices are attached to either or both of said first substantially upright planar member and said second substantially upright planar member.

15. The traffic barricade and safety marker device of claim 14, wherein said adaptable safety devices are selected from the group consisting of: flares, flags, lights, audible warning devices, chains, panels, signs, and vehicle tire deflators.

* * * * *